US011236976B2

(12) United States Patent
Burdette

(10) Patent No.: US 11,236,976 B2
(45) Date of Patent: Feb. 1, 2022

(54) ARROWHEAD

(71) Applicant: Nathaniel Burdette, Bethesda, OH (US)

(72) Inventor: Nathaniel Burdette, Bethesda, OH (US)

( * ) Notice: Subject to any disclaimer, the term of this patent is extended or adjusted under 35 U.S.C. 154(b) by 0 days.

(21) Appl. No.: 16/864,142

(22) Filed: Apr. 30, 2020

(65) Prior Publication Data

US 2021/0010790 A1 Jan. 14, 2021

Related U.S. Application Data

(60) Provisional application No. 62/840,573, filed on Apr. 30, 2019.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 2,212,345 A | | 8/1940 | Krieger | |
| 2,676,017 A | | 4/1954 | Selent et al. | |
| 2,939,708 A | | 6/1960 | Scheib | |
| 3,014,305 A | | 12/1961 | Yuchich | |
| 4,099,720 A | | 7/1978 | Zeren | |
| 4,392,654 A | * | 7/1983 | Carella | F41B 5/1446 264/145 |
| 4,940,246 A | | 7/1990 | Stagg | |
| 5,203,573 A | | 4/1993 | Brailean | |
| 5,613,688 A | * | 3/1997 | Carella | F42B 6/06 473/586 |
| 5,897,449 A | * | 4/1999 | Roberts | F42B 10/26 473/586 |
| 6,077,179 A | | 6/2000 | Liechty, II | |
| 6,306,053 B1 | | 10/2001 | Liechty, II | |
| 6,739,991 B1 | | 5/2004 | Wardropper | |
| 6,958,023 B2 | * | 10/2005 | Simo | F42B 6/06 473/586 |
| 7,025,697 B2 | * | 4/2006 | Mizek | F42B 6/08 473/583 |
| 7,374,505 B2 | | 5/2008 | Polando | |
| 7,905,802 B2 | | 3/2011 | Erhard | |
| 8,771,113 B2 | | 7/2014 | Patton | |
| 9,062,944 B1 | | 6/2015 | Dupuis | |
| 2014/0274502 A1 | | 9/2014 | Sullivan | |

* cited by examiner

*Primary Examiner* — John A Ricci
(74) *Attorney, Agent, or Firm* — Bryce D. Miracle

(57) ABSTRACT

The current application is directed towards a fixed-blade arrowhead that includes an aerodynamic control surface which assists imparting rotation of the arrow during flight, which improves efficiency, flight characteristics, and accuracy while other features ensure proper weight, speed and balance throughout the flightpath.

17 Claims, 14 Drawing Sheets

ARROWHEAD

CROSS-REFERENCE TO RELATED APPLICATION

This application is based upon and claims the priority filing date of the previously filed, U.S. Provisional patent application entitled "ARROWHEAD" filed Apr. 30, 2019, Ser. No. 62/840,573, the entire disclosure of which is hereby incorporated herein by reference.

FIELD OF THE INVENTION

The present invention relates to the field of arrows, and more specifically, to a fixed-blade broadhead.

BACKGROUND

An arrow is a fin-stabilized projectile that is launched via a bow and usually consists of a long straight rigid shaft with stabilizers called fletchings, as well as a heavy arrowhead attached to the front end, and a slot at the rear end defined as a nock for engaging a bowstring. The use of bows and arrows by humans predates recorded history and is common to most cultures.

The arrowhead or projectile point is the primary functional part of the arrow and plays the largest role in determining its purpose. Some arrows may simply use a sharpened tip of the solid shaft, but it is far more common for separate arrowheads to be made, usually from metal, or some other hard material such as stainless steel.

Broadheads are used for primarily hunting purposes. Typical broadhead arrows have two to four sharp blades that inflict bodily destruction to the hunted animal—resulting in severe bodily injury and/or death. Their function is to deliver a wide cutting edge so as to kill as quickly as possible by cleanly cutting major blood vessels and tissue such as the heart, lungs, and other vital organs as well as promote the loss of blood, wherein the animal may be tracked.

There are two main types of broadheads used by hunters: the fixed-blade and the mechanical type. While the fixed-blade are rigid and unmovable at all times, the mechanical broadhead deploys its blades upon contact with the target, wherein the blades swing out to wound the target. The mechanical head flies more efficiently because it is more streamlined throughout its flight path but has less penetration as it uses some of the kinetic energy in the arrow to deploy its blades.

Generally, fixed-blades excel in strength and are more reliable at staying intact, despite impacting bone or other dense material of an intended target when compared to the mechanical blade. However, fixed-blades severely lack in desired flight characteristics and generally have overall poor flight performance.

For the foregoing reasons, there is a need for an improved fixed-blade broadhead which provides superior flight characteristics while maintaining structural integrity.

SUMMARY

The current application is directed towards a fixed-blade arrowhead that includes an aerodynamic control surface which assists imparting rotation of the arrow during flight, which improves efficiency, flight characteristics, and accuracy while other features ensure proper weight, speed and balance throughout the flightpath.

In a version of the application, the arrowhead generally comprises a central body which has a longitudinal axis, an outer surface, a front end and a rear end configured for attachment to a shaft of an arrow; and a plurality of wing blades attached to the central body. Each wing blade extends radially at an angle from the front end of the central body, each spaced equidistantly about a circumference of the central body.

In certain versions, each wing blade may include a blade element comprising an upper surface, a lower surface, a leading edge, a trailing edge, and a root edge defined where the wing blade meets the central body. The leading edge is at a predetermined angle with respect to the longitudinal axis of the central body and the trailing edge is parallel to the leading edge defining a constant width therebetween. Further, a steering portion is provided which includes an aerodynamic control surface defined by a leading edge, a trailing edge, an inner edge, and an outer edge. Preferably, the leading edge of the steering portion is colinear with the leading edge of the blade element and merges at a point with the root edge of the blade element.

In certain versions, the aerodynamic control surface diverges from the blade element upper surface extending rearward from the leading edge and the trailing edge of the aerodynamic control surface is positioned aftward of the trailing edge of the upper surface.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other versions that depart from these specific details. In other instances, detailed descriptions of well-known devices and methods are omitted so as not to obscure the description of the present invention with unnecessary detail.

The following detailed description is of the best currently contemplated modes of carrying out exemplary versions of the invention. The description is not to be taken in the limiting sense but is made merely for the purpose of illustrating the general principles of the invention, since the scope of the invention is best defined by the appended claims. Various inventive features are described below that can each be used independently of one another or in combination with other features.

Referring now to the figures wherein the showings are for purposes of illustrating a preferred version of the invention only and not for purposes of limiting the same, the present application discloses a fixed-blade broadhead which boasts a strong, resilient structure and superior flight characteristics. The broadhead is configured to be attachably removable the shaft of an arrow.

Initially with reference to FIG. 1-FIG. 9, in a version of the application the arrowhead 10 or fixed-blade broadhead generally comprises a ferrule or central body 12 and a plurality of wing blades 14*a*, 14*b*, and 14*c* which are radially attached about the central body 12. Each of the wing blades 14*a*, 14*b*, and 14*c* includes at least a steering portion 40 which generally provides an aerodynamic control surface 30.

Figure 4:
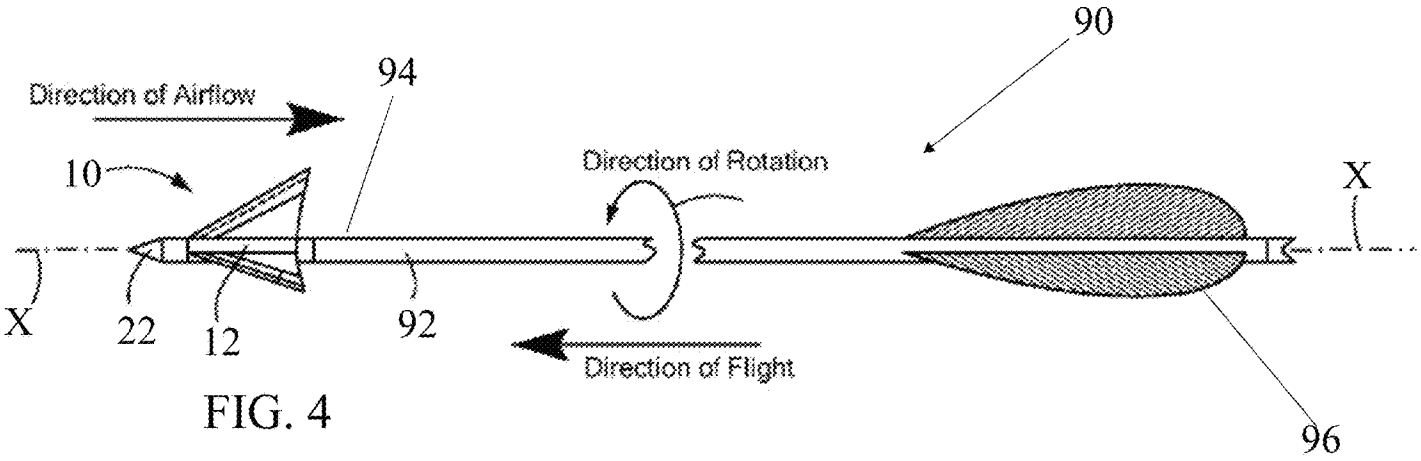
FIG. 4 is an illustrative view of an arrow including the arrowhead of the version shown in FIG. 1 and shaft.
Figure 5:
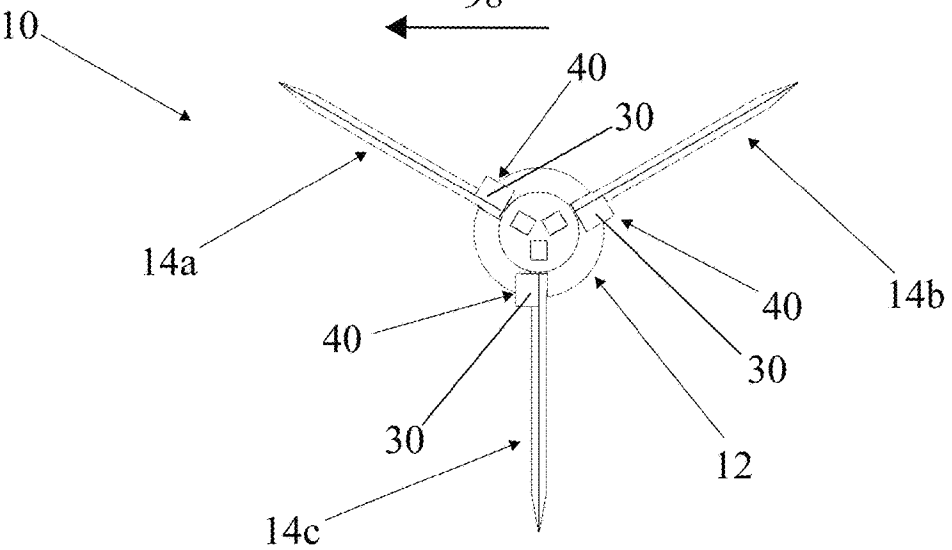
FIG. 5 is a top plan view of the version shown in FIG. 1.
Figure 6:
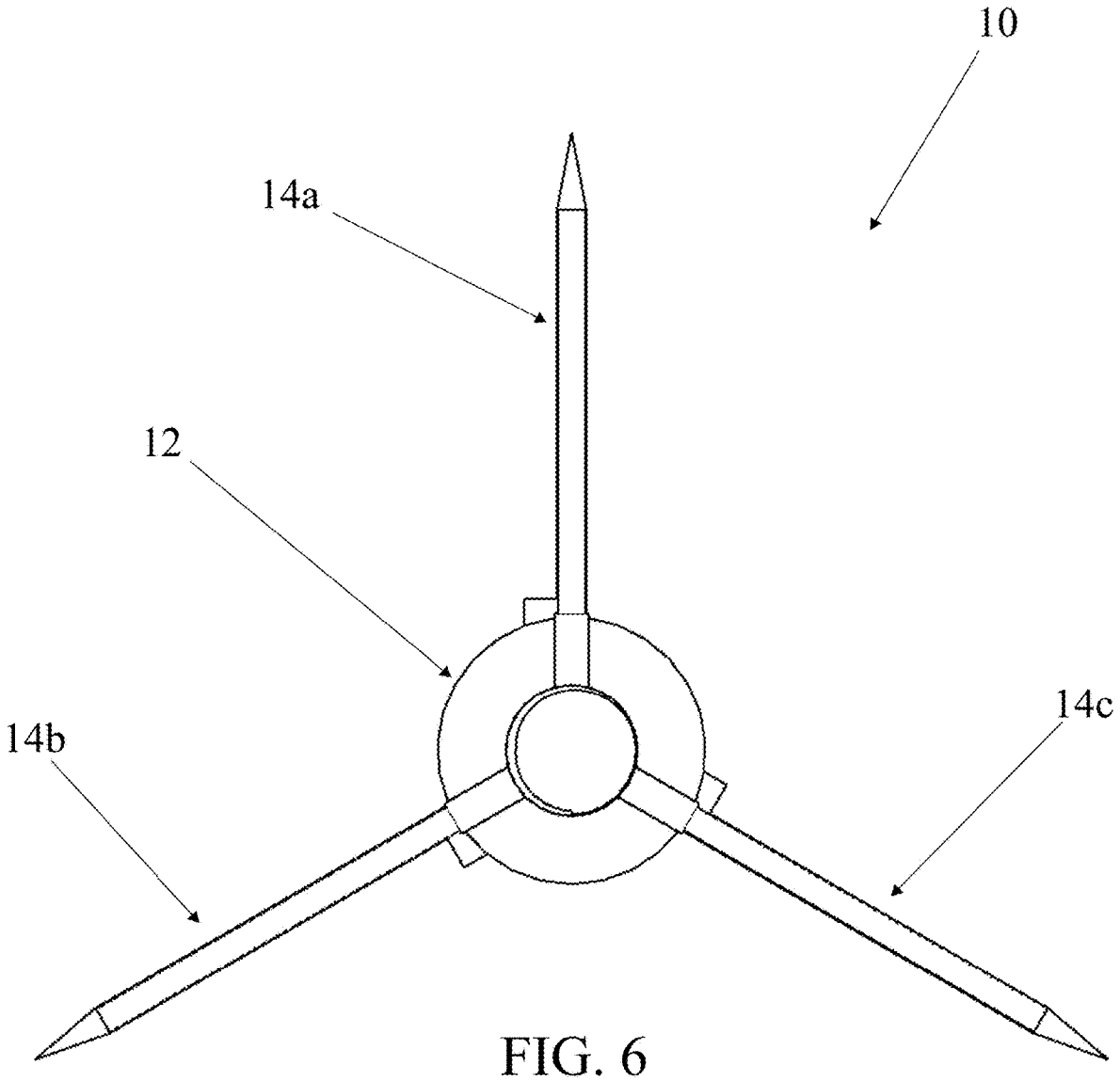
FIG. 6 is a bottom plan view of the version shown in FIG. 1.
Figure 7:
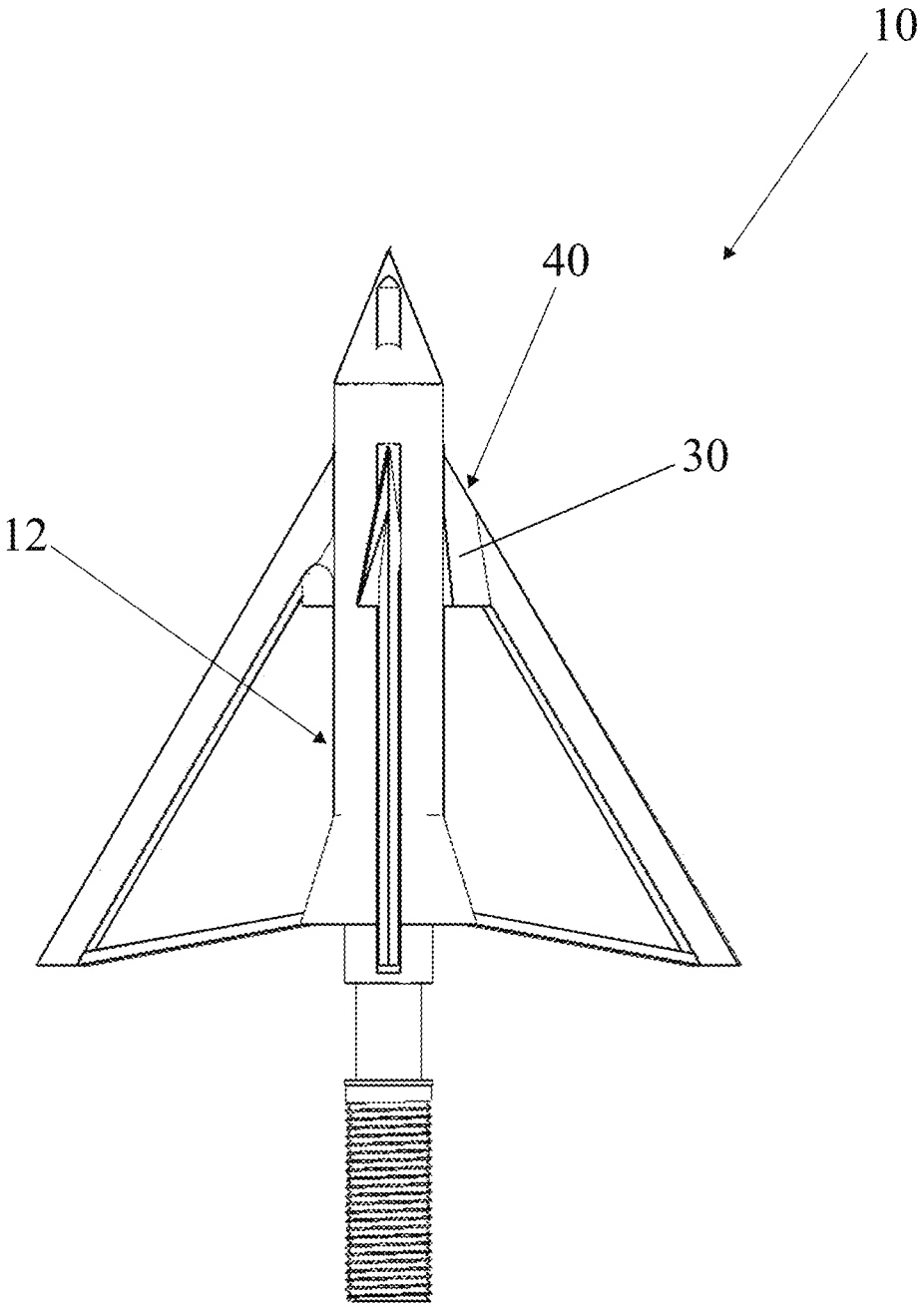
FIG. 7 is a side elevation view of the version shown in FIG. 1.
Figure 8:
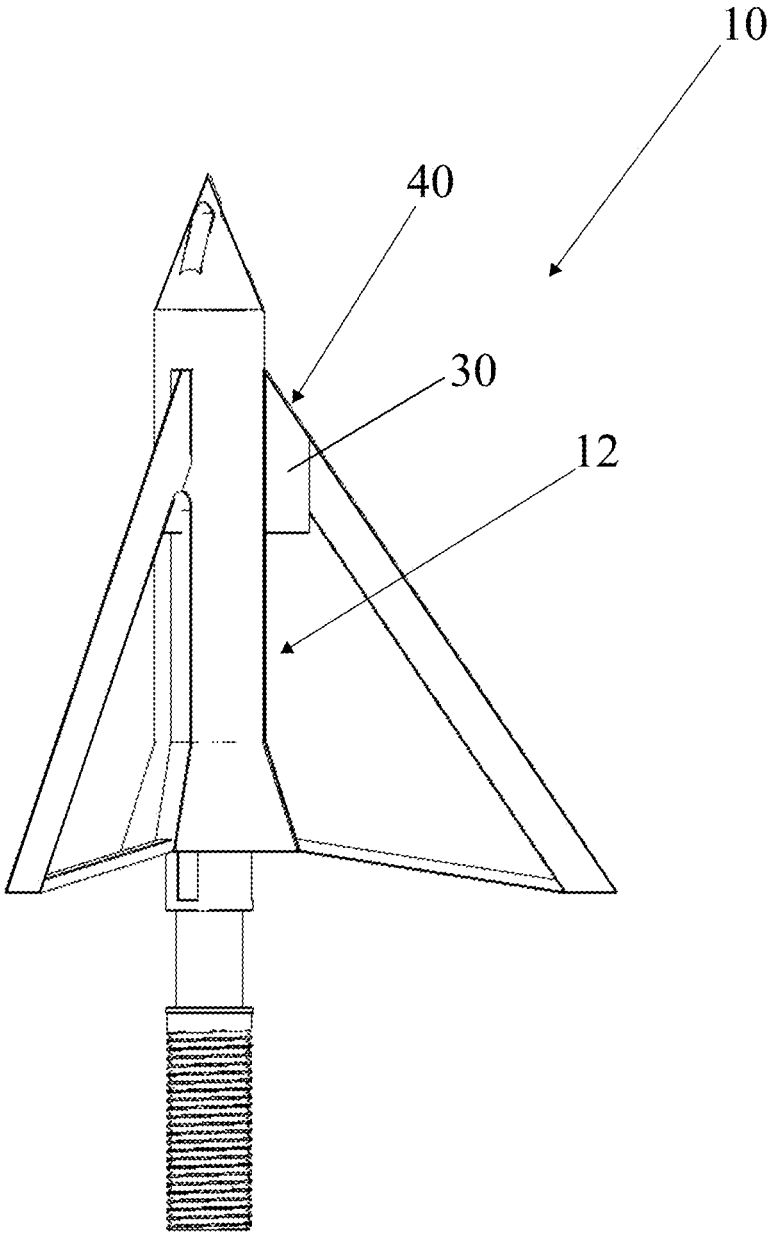
FIG. 8 is a side elevation view of the version shown in FIG. 1.
Figure 9:
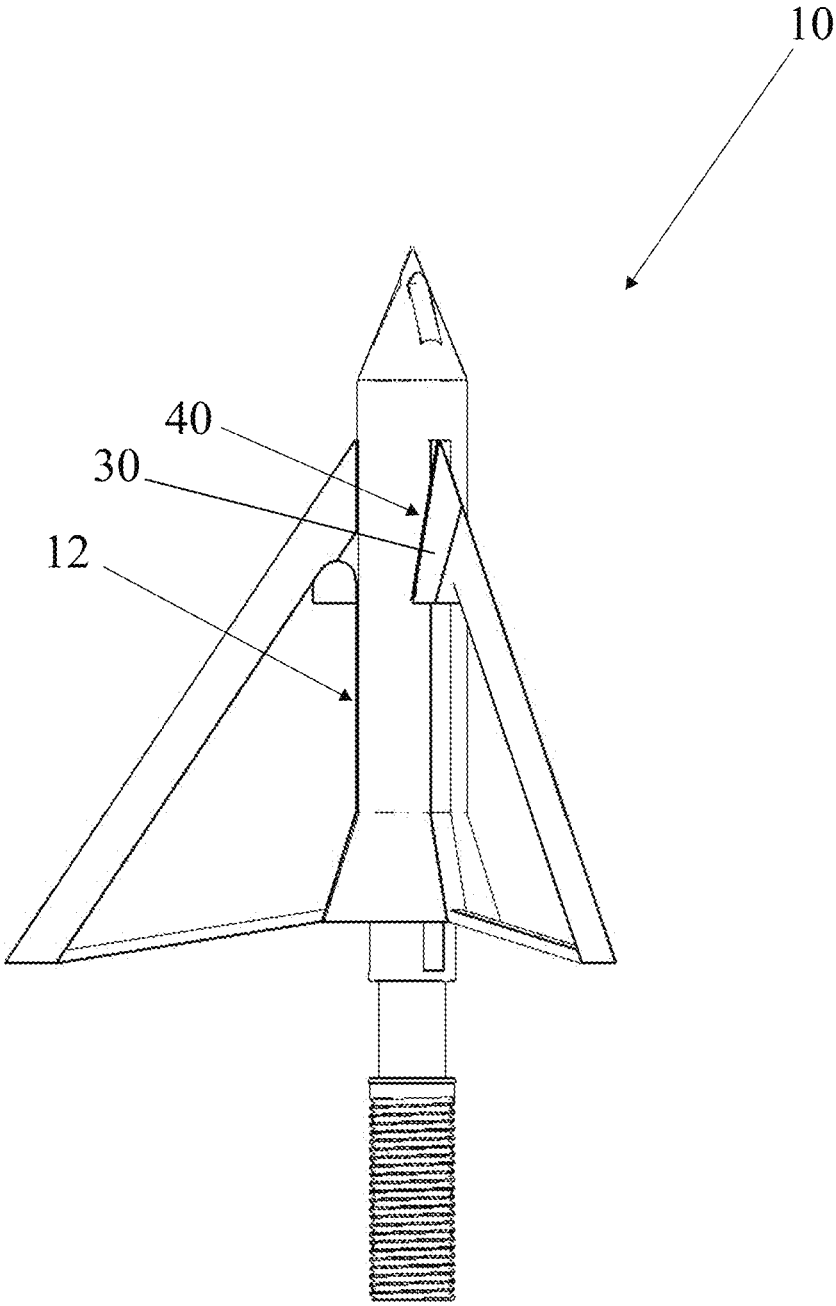
FIG. 9 is a side elevation view of the version shown in FIG. 1.

With reference to FIG. 4 and FIG. 5, as the arrow 90 travels through the air, the aerodynamic control surfaces 30 act to induce a lifting force on each wing blade 14, imparting a rotation to the arrowhead 10 and arrow 90 having stabilizers 96. Preferably, the arrowhead 10 is generally configured to universally attach to the forward end 94 of the shaft 92 of an arrow 90.

FIG. 10-FIG. 15 show the ferrule or central body 12 omitting the plurality of wing blades 14. The ferrule or central body 12 includes an elongated body having a front end 16, a rear end 18, an outer surface 20 having a longitudinal axis X (See FIG. 13). In the illustrated version, the central body 12 generally comprises a cylindrical midsection 24 having a diameter and a circumference, a conical tip 22 positioned above the cylindrical midsection 24, and a tail portion 26 extending below the cylindrical midsection 24. The conical tip 22 positioned at the front end 16 terminates at a leading end or vertex 25 which is designed to penetrate objects upon impact. The tail portion 26 at the rear end 18 comprises a cylindrical male threaded shaft 28 which is operably configured to seat and affix with the forward end the shaft 92 of the arrow 90 (See FIG. 4).

In a version of the application, the central body 12 midsection 24 includes a plurality of longitudinal slots 32 formed along the length of the central body 12 in parallel alignment with the longitudinal axis X of the central body 12. Each longitudinal slot 32 extends substantially the full length of the midsection 24 and spaced equidistant about the circumference thereof. Each longitudinal slot 32 also extends a forward distance into and through the conical tip 22 and a rearward distance into the tail portion 26. Each longitudinal slot 32 corresponds to coupling with a respective wing blades 14*a*-14*c*. Generally, the longitudinal slots 32 are operably configured to firmly seat each corresponding wing blade 14. Typically, three longitudinal slots 32 and three wing blades 14*a*-14*c* are provided, although another number, such as two, four, five, or six, could be used if desired.

In the version, the midsection 24 may further include a base support 80 which expand in diameter from a first midsection diameter to a greater diameter forming a conical frustum. The base support 80 provides further support to the wing blade 14 rear extension while seated.

Figure 1:
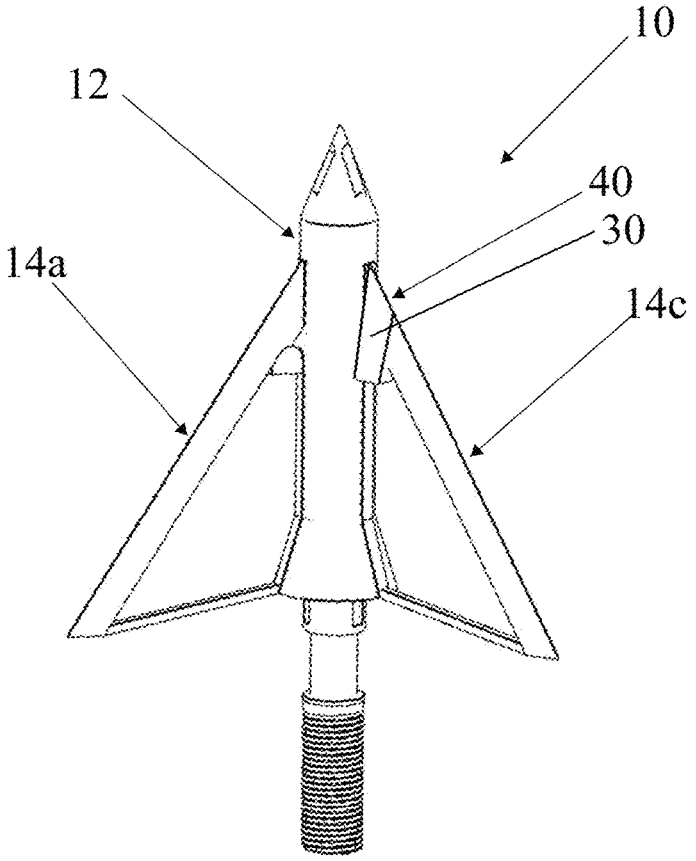
FIG. 1 is a side perspective view of a version of the application.
Figure 2:
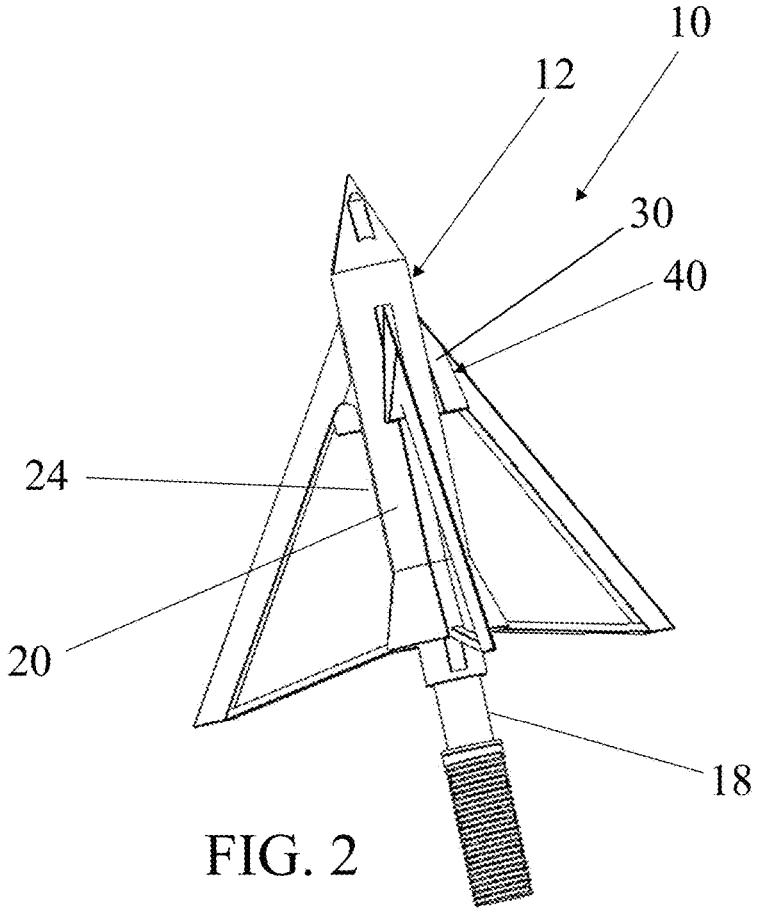
FIG. 2 is a side perspective view of the version shown in FIG. 1.
Figure 3:
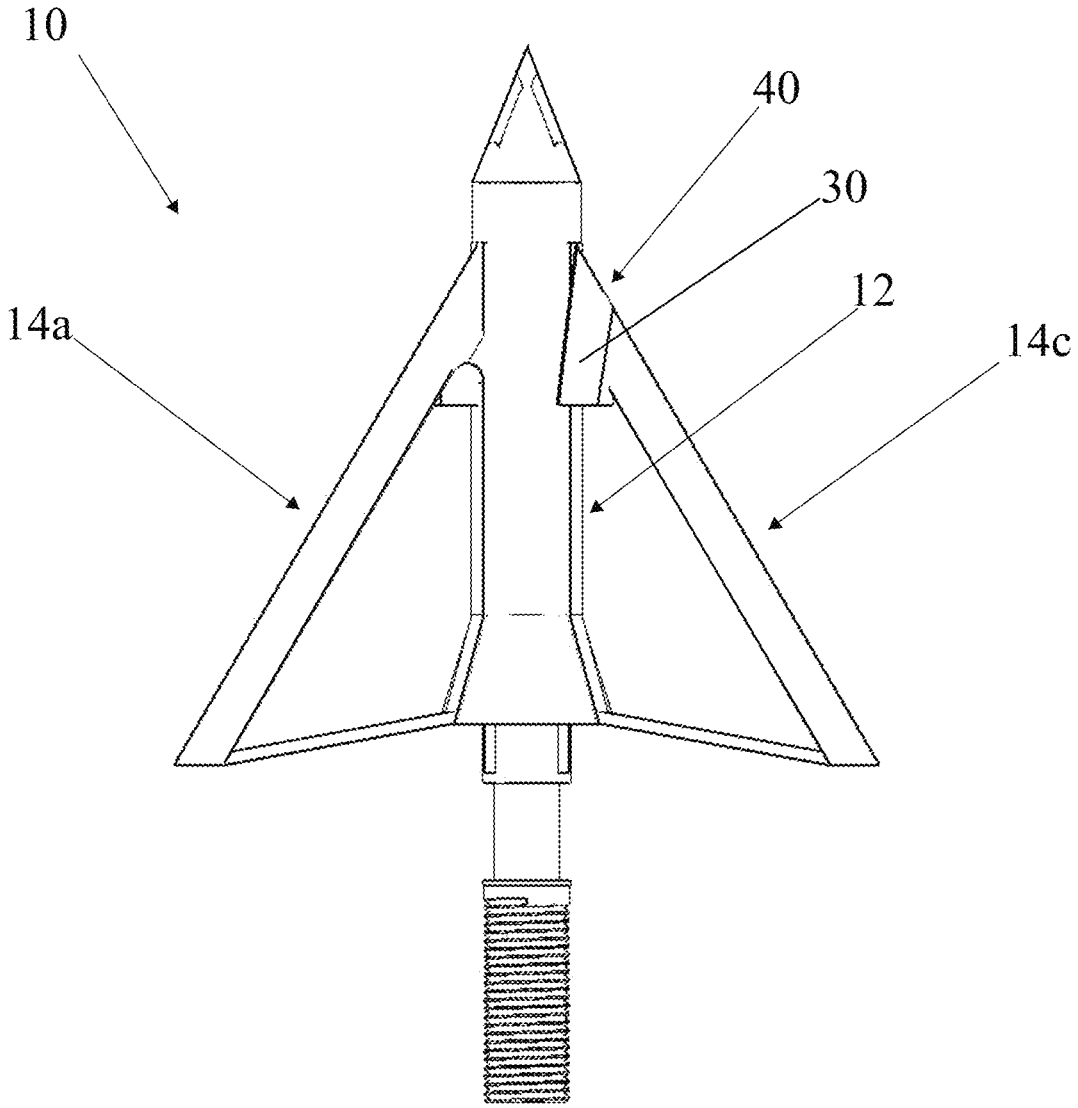
FIG. 3 is an elevation view of the version shown in FIG. 1.

With reference to FIG. 2, the wing blades 14*a*-14*c* are generally radially positioned equidistant about the central body 12, each wing blade 14 having a similar orientation and configuration. Generally, each wing blade 14 is attachably removable from the central body 12.

Referring now to FIG. 16-FIG. 19, in the version, each wing blade 14*a*, 14*b*, and 14*c* generally comprises a longitudinally extending shoulder portion 34, a blade element 38 extending from the shoulder portion 34, and a steering portion 40 having an aerodynamic control surface 30. The blade element 38 generally extends outward and rearward at a predetermined angle from a forward most point 42 at the front end 44 of the shoulder portion 34 to a rear most point 46.

Figures 10, 11, 12:
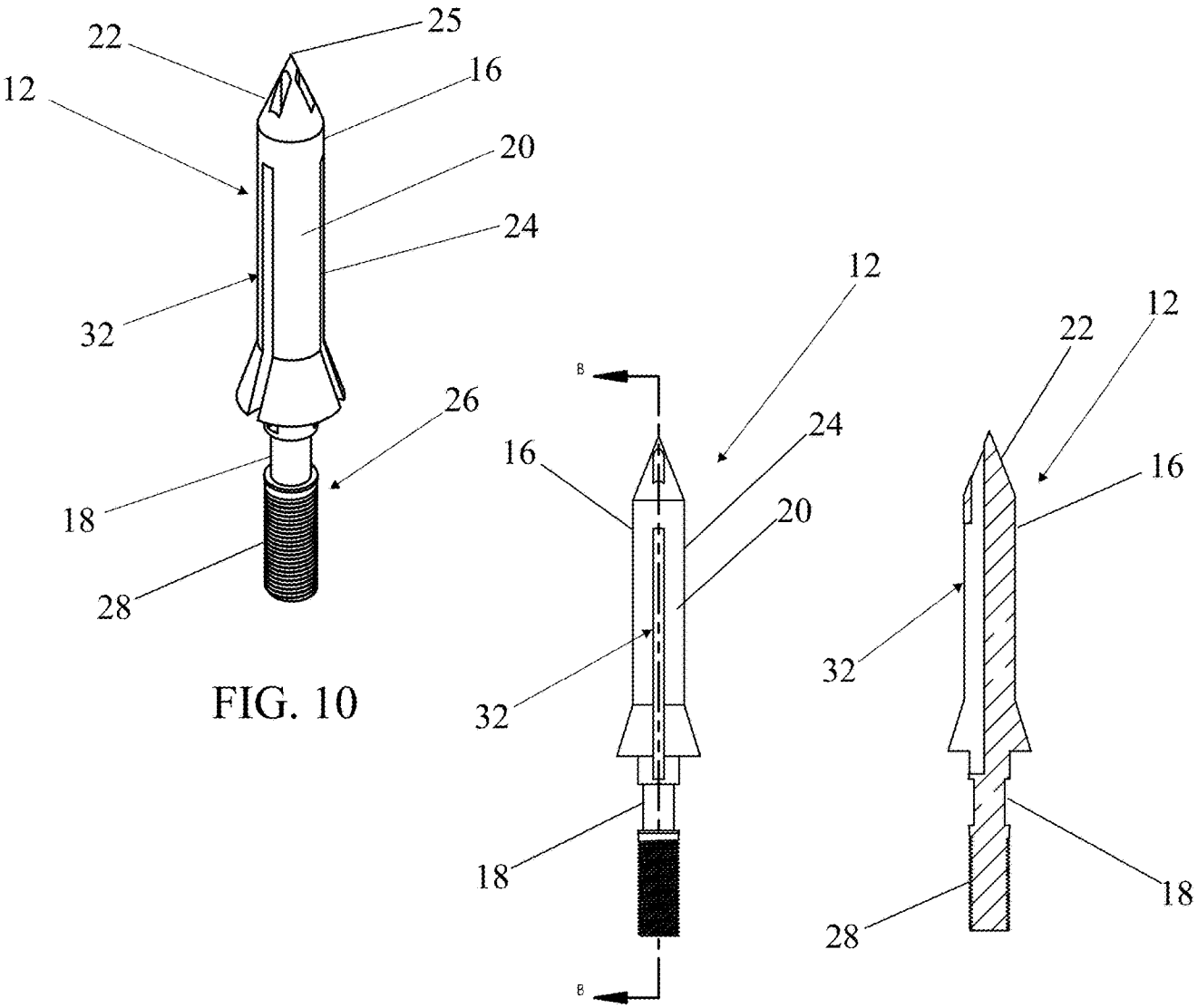
FIG. 10 is a perspective view of a version of the central body shown apart from the wing blades.
FIG. 11 is a side elevation view of the central body of the version shown in FIG. 10.
FIG. 12 is a cross-section view of the central body taken along lines B-B shown in FIG. 11.
Figure 15:
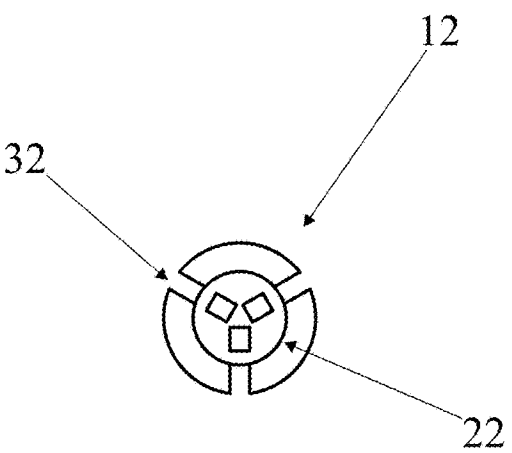
FIG. 15 is a top plan view of the central body of the version shown in FIG. 10.
Figure 14:
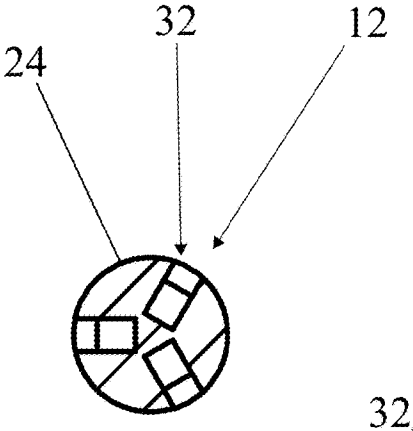
FIG. 14 is a cross-section view of the central body taken along lines C-C shown in FIG. 13.
Figure 13:
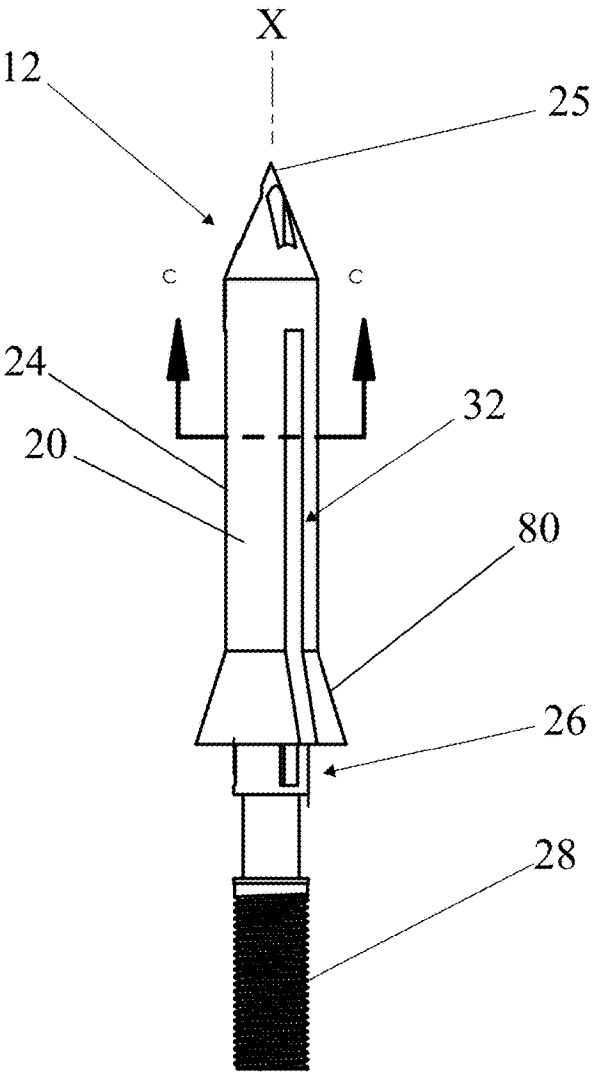
FIG. 13 is a side elevation view of the central body of the version shown in FIG. 10.
Figure 17:
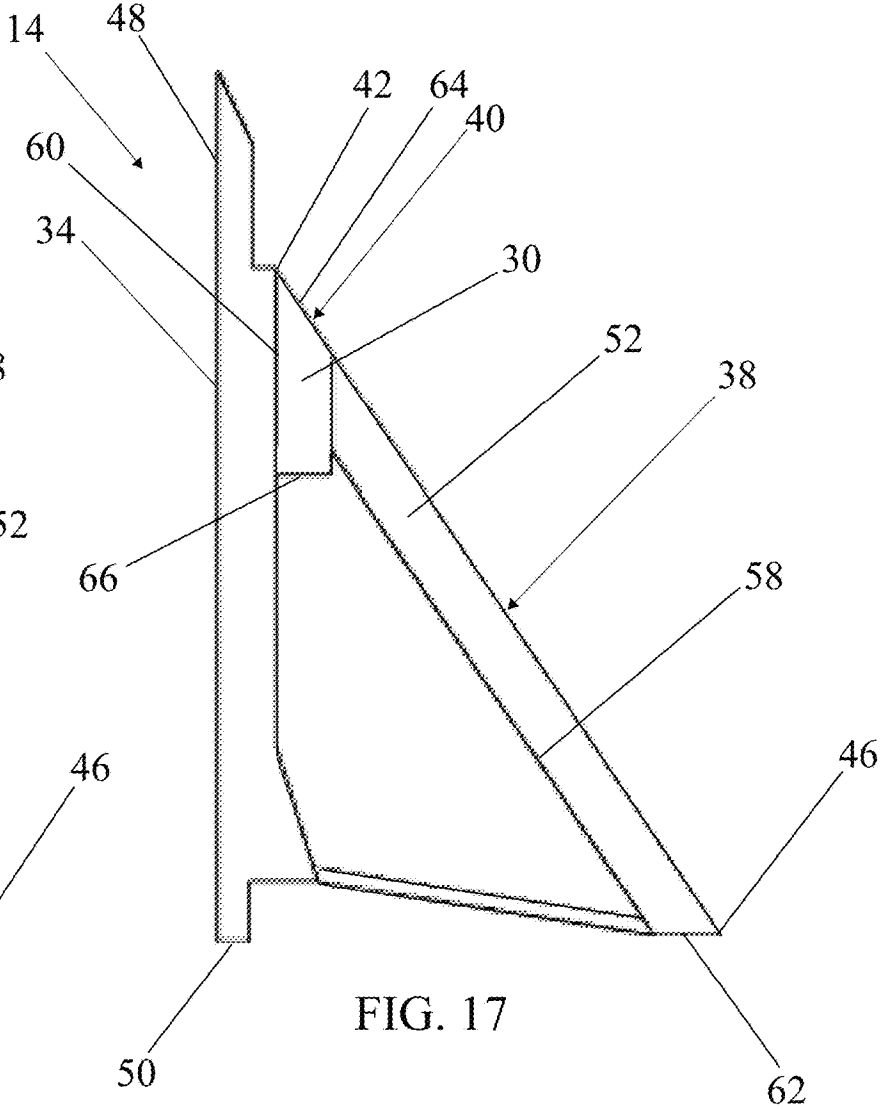
FIG. 17 is a front elevation view of the wing blade shown in FIG. 16.
Figure 16:
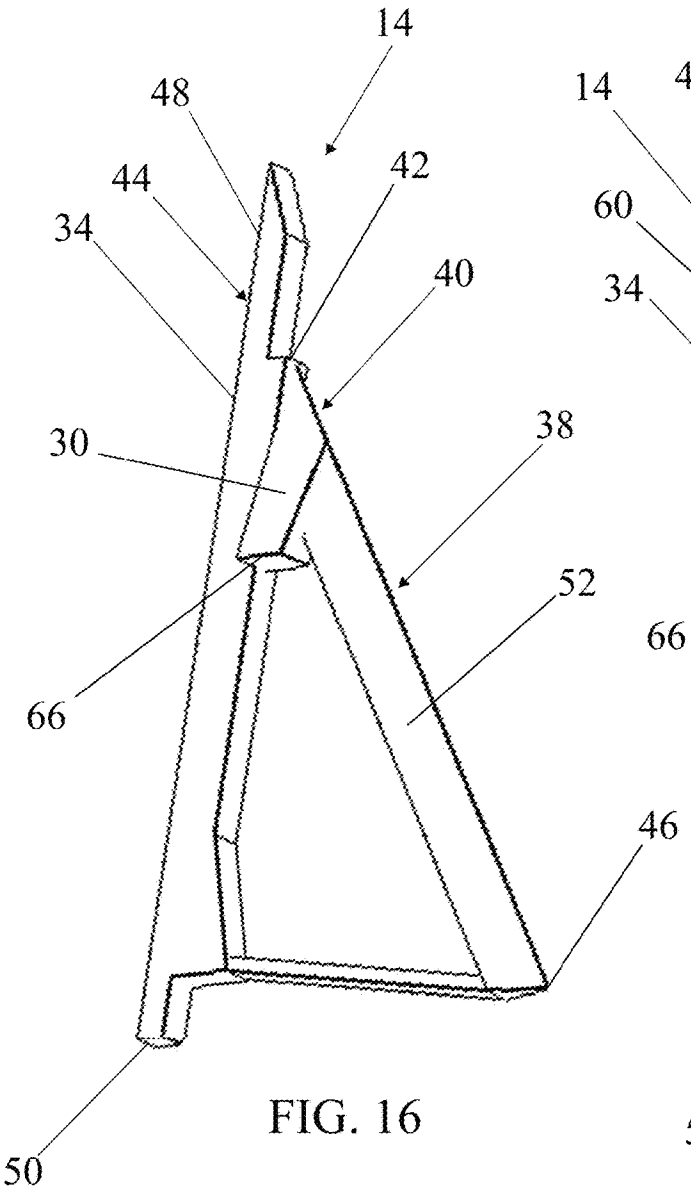
FIG. 16 is a side perspective view of a version of the wing blade shown apart from the central body.
Figure 19:
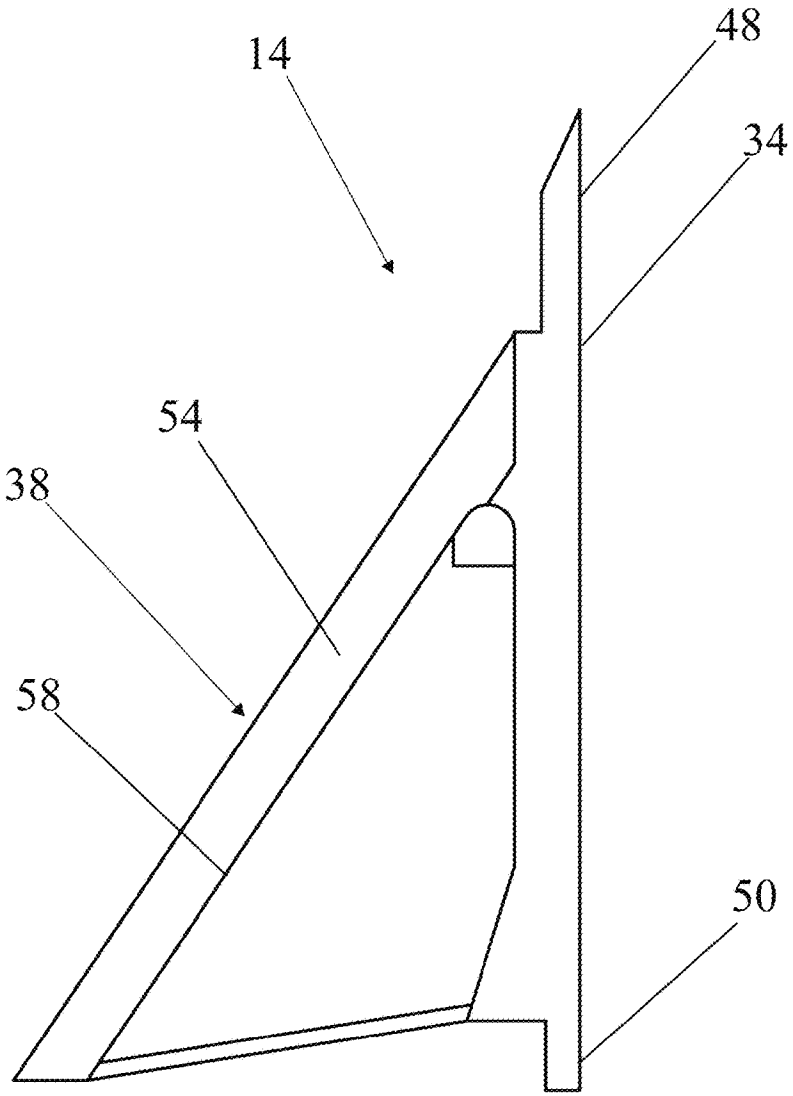
FIG. 19 is a rear elevation view of the wing blade shown in FIG. 16.
Figure 18:
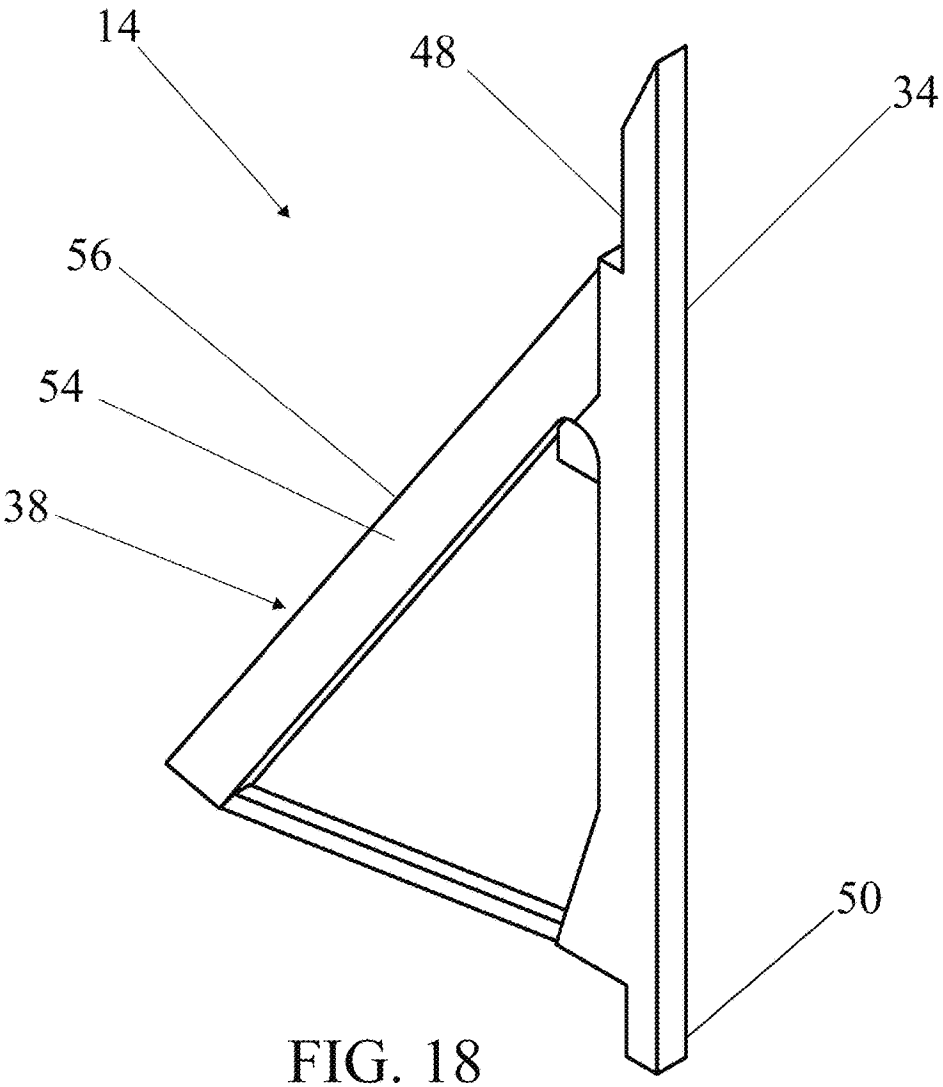
FIG. 18 is a rear side perspective view of the version of the wing blade shown in FIG. 16.
Figure 22:
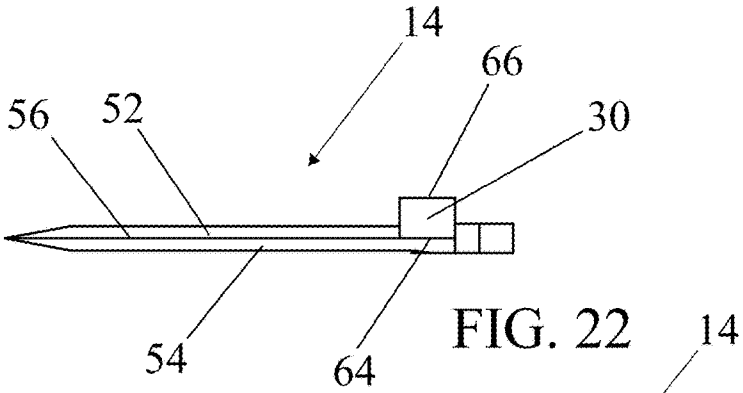
FIG. 22 is a top plan view of the wing blade shown in FIG. 16.
Figure 23:
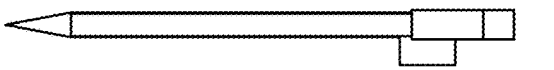
FIG. 23 is a bottom plan view of the wing blade shown in FIG. 16.
Figure 21:
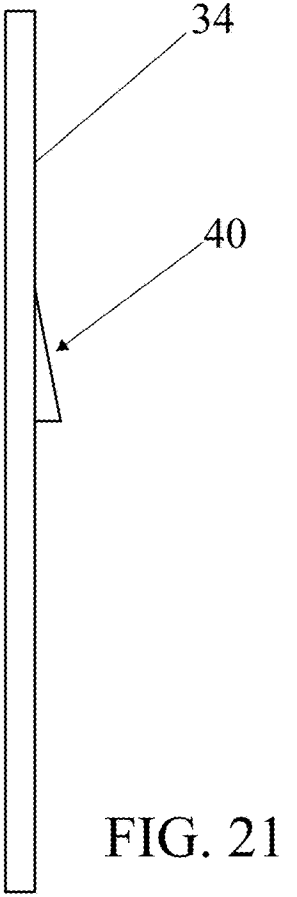
FIG. 21 is an interior side elevation view of the wing blade shown in FIG. 16.
Figure 20:
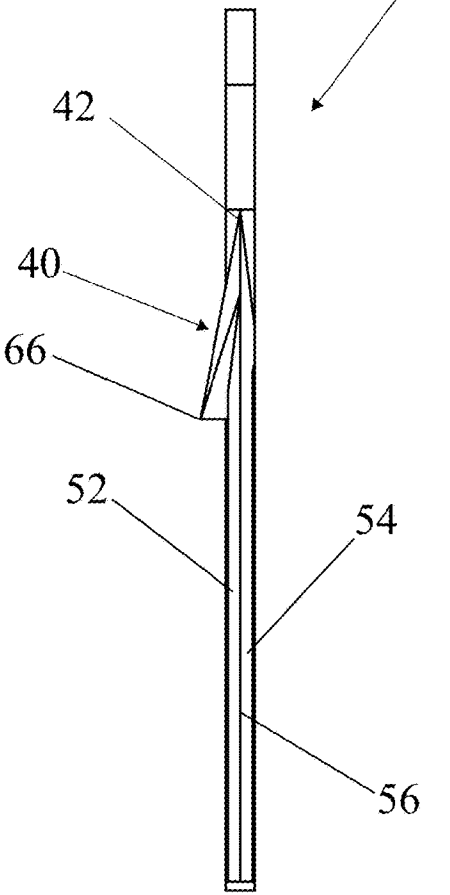
FIG. 20 is side elevation view of the wing blade shown in FIG. 16.
Figure 24:
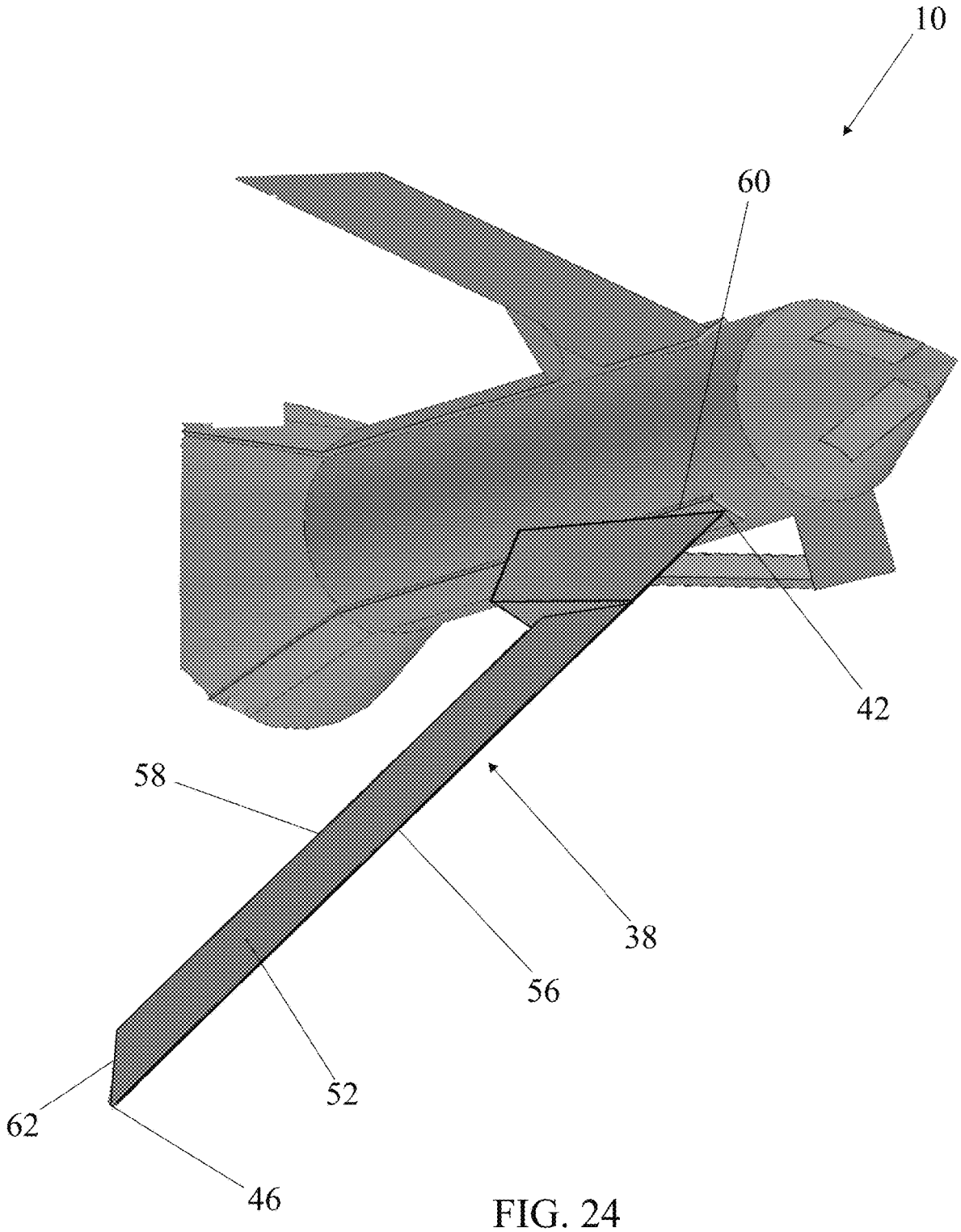
FIG. 24 is a top down perspective rendering of a version of the arrowhead showing the steering portion.
Figure 25:
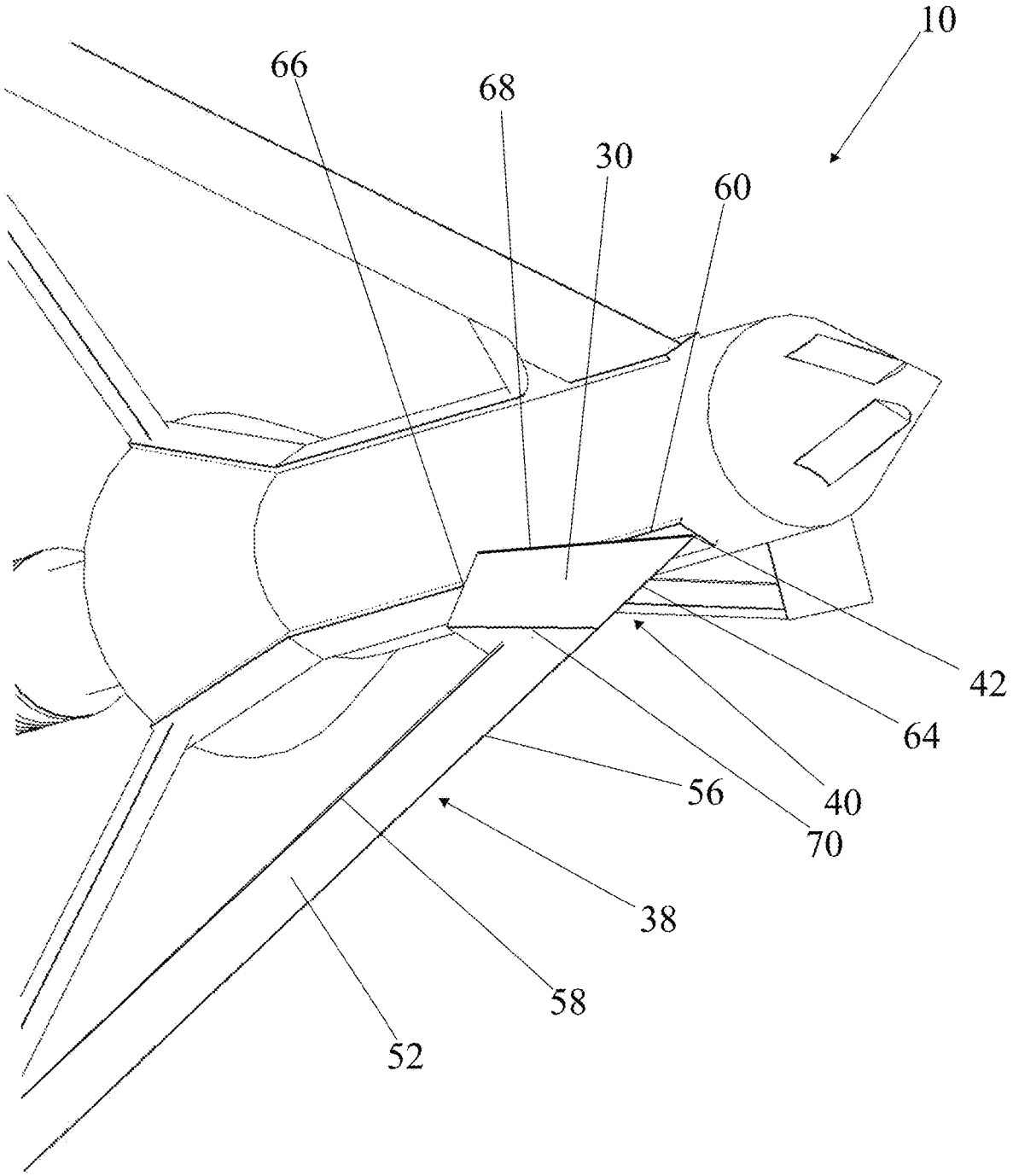
FIG. 25 is a top down perspective view of a version of the arrowhead showing the steering portion.

In further reference to FIG. 11 and FIG. 12, the longitudinally extending shoulder portion 34 generally corresponds and fits snugly into a respective longitudinal slot 32 on the central body 12. The shoulder portion 34 includes a forward extension 48 and a rear extension 50. The length of the shoulder portion 34 corresponds to the length of the longitudinal slot 32 on the central body 12. The shoulder portion 34 fits into a corresponding longitudinal slot 32, wherein the forward extension 48 of the shoulder portion 34 is placed into the portion of the longitudinal slot 32 which passes through the conical tip 22 and the rear extension 50 of the shoulder portion 34 is positioned within the longitudinal slot 32 in the tail portion 26 of the central body 12. The depth of each longitudinal slot 32 is the same, or substantially the same within manufacturing tolerances, as the depth of the forward extension 48 and rear extension 50 of the shoulder portion 34 so that the forward extensions 48 and the rear extension 50 do not protrude above the outer surface 20 of the midsection 24 of central body 12. Preferably, the wing blades 14*a*-14*c*, when attached, fit snugly, not loosely, to the central body 12.

Referring to the version illustrated in FIG. 16-FIG. 25 shown aside from the central body 12, each wing blade 14 blade element 38 comprises an upper surface 52 and a lower surface 54, each surface provided at an angle with respect to the other forming a leading edge 56 designed to cut the intended target during application. In the version, the leading edge 56 is linear and extends outward and rearward at a predetermined angle with respect to the central body 12 longitudinal axis X from the forward most point 42 at the root edge 60 to the rear most point 46 at the wing tip edge 62. The blade element 38 further comprises a trailing edge 58 which extends parallel with the leading edge 56 and defining a constant width therebetween from the root edge 60 and terminating outward at the wing tip edge 62.

As best shown in FIG. 20-FIG. 25, the wing blades 14*a*-14*c* include a steering portion 40, preferably located near the root edge 60 of the blade element 38. In the version, the steering portion 40 comprises an aerodynamic control surface 30 defined by a leading edge 64, a trailing edge 66, an inner edge 68, and an outer edge 70. The leading edge 64 of the steering portion 40 is colinear with the leading edge 56 of the blade element 38 and merges at the forward most point 42 with the root edge 60 of the blade element 38. The aerodynamic control surface 30 generally diverges away from the blade element 38 upper surface 52 extending aftward from the leading edge 64. Further, it is preferable that the trailing edge 66 of the aerodynamic control surface 30 is positioned rearward or aft of the trailing edge 58 of the of the blade element 38 upper surface 52.

Generally, the steering portion 40 extends outward or above the upper surface 52 near the root edge 60 and shoulder portion 34 providing an elevated surface or aerodynamic control surface 30 which assists with imparting rotation to the arrowhead 10 and guidance throughout the flightpath of the arrow 90. The aerodynamic control surface 30 can have varying curvatures for providing desired flight characteristics such as being flat, curved, concave, angled, slanted, planar, etc.

The configuration of the wing blade 14, including the steering portion 40, creates a type of airfoil which causes the arrowhead 10 to rotate, such that, during flight, the airflow path length across the aerodynamic control surface 30 is greater than the airflow path length across the lower surface 54 of the blade element 38, thereby generating lift. As best illustrated in FIG. 4 and FIG. 5, when the arrow 90 is in flight, lift is generated over the aerodynamic control surface 30 of each wing blade 14, which imparts a roll or a rotation 98 about a longitudinal axis X of the arrowhead 10 and the arrow 90.

As illustrated in the figures, the rotation in flight is in the counterclockwise direction, as represented by rotation 98 when the arrowhead 10 is viewed from the front, as shown in FIG. 5. Of course, if the steering portion 40 was positioned on the opposing side or lower surface 54 of the wing blade 14, the arrow would spin in the clockwise direction.

Preferably, the construction of the arrowhead 10 is formed by a combination of materials—namely, carbon fiber, plastics, and light weight metals. Preferably, the wing blades 14*a*-14*c* are made of either Stainless Steel, Aluminum, and/or Tungsten. Most preferably, the wing blades 14*a*-14*c* are made of Tungsten. Moreover, the leading edge 56 of the blade element 38 may be lined with carbon fiber in order to reduce weight while strengthening the construction thereof.

The invention does not require that all the advantageous features and all the advantages need to be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. An arrowhead, comprising:

a central body having a longitudinal axis, an outer surface, a front end and a rear end, the central body configured for attachment to a shaft of an arrow; and a plurality of wing blades positioned about the outer surface of the central body, wherein each wing blade comprises:

a blade element comprising an upper surface, a lower surface, a leading edge, a trailing edge, and a root edge defined where the blade element meets the central body; and a steering portion comprising an aerodynamic control surface defined by a leading edge, a trailing edge, an inner edge, and an outer edge; the leading edge of the steering portion is colinear with the leading edge of the blade element and merges at a point with the root edge of the blade element, the aerodynamic control surface diverging from the blade element upper surface extending aftward from the leading edge.

2. The arrowhead of claim 1, wherein each wing blade extends radially at an angle from the front end of the central body, the wing blades spaced equidistantly about a circumference of the central body.

3. The arrowhead of claim 2, wherein the leading edge is at a predetermined angle with respect to the longitudinal axis of the central body and the trailing edge is parallel to the leading edge defining a constant width therebetween.

4. The arrowhead of claim 3, wherein the trailing edge of the aerodynamic control surface is positioned aftward of the trailing edge of the upper surface.

5. The arrowhead according to claim 1, wherein each the wing blade is removably attached to the central body.

6. The arrowhead of claim 5, wherein each wing blade further comprises a shoulder portion having a forward extension and a rear extension; wherein the central body further comprises a conical tip and a plurality of longitudinally extending slots configured to receive and seat the respective shoulder portion of each wing blade, each of the plurality of longitudinally extending slots extending from the rear end of the central body and through the conical tip.

7. The arrowhead according to claim 1, wherein the aerodynamic control surface is flat.

8. The arrowhead according to claim 1, wherein the aerodynamic control surface is curved.

9. An arrowhead, comprising:

a central body having a longitudinal axis, an outer surface, a front end and a rear end configured for attachment to a shaft of an arrow; and a plurality of wing blades attached to the central body, each wing blade extending radially at an angle from the front end of the central body, the wing blades spaced equidistantly about a circumference of the central body, wherein each wing blade comprises:

a blade element comprising an upper surface, a lower surface, a leading edge, a trailing edge, and a root edge defined where the wing blade meets the central body, wherein the leading edge is at a predetermined angle with respect to the longitudinal axis of the central body and the trailing edge is parallel to the leading edge defining a constant width therebetween; and a steering portion comprising an aerodynamic control surface defined by a leading edge, a trailing edge, an inner edge, and an outer edge; the leading edge of the steering portion is colinear with the leading edge of the blade element and merges at a point with the root edge of the blade element, the aerodynamic control surface diverging from the blade element upper surface from the leading edge, the trailing edge of the aerodynamic control surface is positioned aftward of the trailing edge of the upper surface.

10. The arrowhead according to claim 9, wherein the aerodynamic control surface is flat.

11. The arrowhead according to claim 9, wherein the aerodynamic control surface is curved.

12. The arrowhead according to claim 9, wherein each the wing blade is removably attached to said central body.

13. The arrowhead of claim 12, wherein each wing blade further comprises a shoulder portion having a forward extension and a rear extension; wherein the central body further comprises a conical tip and a plurality of longitudinally extending slots configured to receive and seat the respective shoulder portion of each wing blade, each of the plurality of longitudinally extending slots extending from the rear end of the central body and through the conical tip.

14. An arrowhead, comprising:

a central body having a longitudinal axis, an outer surface, a front end terminating at a conical tip, and a rear end configured for attachment to a shaft of an arrow, wherein the central body comprises a plurality of longitudinally extending slots exposed within the outer surface extending from the rear end and longitudinally through the conical tip; and a plurality of wing blades attached to the central body, each wing blade extending radially at an angle from the front end of the central body, the wing blades spaced equidistantly about a circumference of the central body, wherein each wing blade comprises:

a shoulder portion having a forward extension and a rear extension, the shoulder portion operably configured to seat within a respective longitudinal slot of the central body, wherein the forward extension couples with and through the conical tip;

a blade element comprising an upper surface, a lower surface, a leading edge, a trailing edge, and a root edge defined where the wing blade meets the central body, wherein the leading edge is at a predetermined angle with respect to the longitudinal axis of the central body and the trailing edge is parallel to the leading edge defining a constant width therebetween; and a steering portion comprising an aerodynamic control surface defined by a leading edge, a trailing edge, an inner edge, and an outer edge; the leading edge of the steering portion is colinear with the leading edge of the blade element and merges at a point with the root edge of the blade element, the aerodynamic control surface diverging from the blade element upper surface from the leading edge, the trailing edge of the aerodynamic control surface is positioned aftward of the trailing edge of the upper surface.

15. The arrowhead according to claim 14, wherein the aerodynamic control surface is flat.

16. The arrowhead according to claim 14, wherein the aerodynamic control surface is curved.

17. The arrowhead according to claim 14, wherein the central body further comprises a base support which expands in diameter from a first diameter to a greater diameter forming a conical frustum.

* * * * *